US008471663B2

(12) United States Patent
Cho et al.

(10) Patent No.: US 8,471,663 B2
(45) Date of Patent: Jun. 25, 2013

(54) COMBINED WINDING STRUCTURE AND MAGNETIC DEVICE

(75) Inventors: Ching-Hui Cho, Taoyuan Hsien (TW); Ching-Hsien Teng, Taoyuan Hsien (TW); Pai-Hsuan Wang, Taoyuan Hsien (TW); Yu-Liang Liu, Taoyuan Hsien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 13/267,118

(22) Filed: Oct. 6, 2011

(65) Prior Publication Data

US 2013/0015932 A1 Jan. 17, 2013

(30) Foreign Application Priority Data

Jul. 11, 2011 (TW) ..... 100124461 A

(51) Int. Cl.
*H01F 27/28* (2006.01)

(52) U.S. Cl.
USPC ..... 336/182

(58) Field of Classification Search
USPC ..... 336/65, 83, 170, 173, 180–184, 192
See application file for complete search history.

(56) References Cited

U.S. PATENT DOCUMENTS

| | | | | |
|---|---|---|---|---|
| 3,812,443 | A * | 5/1974 | Schroeder | 336/192 |
| 4,901,048 | A | 2/1990 | Williamson | |
| 5,027,099 | A * | 6/1991 | Burke et al. | 336/60 |
| 6,472,969 | B1 | 10/2002 | Hanato | |
| 6,617,948 | B2 * | 9/2003 | Kuroshima et al. | 336/83 |
| 6,956,456 | B2 * | 10/2005 | Mihara et al. | 336/178 |
| 7,443,278 | B2 | 10/2008 | Kawahata et al. | |
| 7,791,444 | B2 * | 9/2010 | Tomonari et al. | 336/192 |
| 7,932,803 | B2 * | 4/2011 | Hirai | 336/220 |

* cited by examiner

*Primary Examiner* — Tuyen Nguyen
(74) *Attorney, Agent, or Firm* — Cantor Colburn LLP

(57) ABSTRACT

A combined winding structure is provided. The combined winding structure includes a plurality of winding wires each having a winding portion in a hollow column form, an anodic portion and a cathodic portion; the anodic portions and the cathodic portions are integrally extended from the winding portions respectively. The winding portions each have a surrounding dimension, and the surrounding dimensions are mutually different. The winding portion with the smaller surrounding dimension is located inside and surrounded by the winding portion with the larger surrounding dimension. With these arrangements, the combined winding structure can have a larger equivalent cross-sectional area and lower production costs. A magnetic device is also provided, which includes the aforesaid combined winding structure.

7 Claims, 10 Drawing Sheets

COMBINED WINDING STRUCTURE AND MAGNETIC DEVICE

CROSS-REFERENCES TO RELATED APPLICATIONS

This application claims priority to Taiwan Patent Application No. 100124461 filed on Jul. 11, 2011.

BACKGROUND OF THE INVENTION

1. Field of the Invention

The present invention relates to a winding structure and a magnetic device comprising the same, and more particularly, to a combined winding structure and a magnetic device comprising the same.

2. Descriptions of the Related Art

Winding (coil) structures are widely used in various magnetic devices such as inductors (choke coils), transformers or filters. To be used in magnetic devices with a large current, a winding structure must be formed of a winding wire whose cross section is larger than a predetermined value to reduce the impedance (copper loss) to the current and improve the efficiency of the magnetic device. Furthermore, the reduced impedance to the current also helps to reduce heat energy produced by the winding structure.

To obtain a large wire cross section, a flat wire is usually used to produce the winding structure as disclosed in U.S. Pat. No. 4,901,048 for example. However, it is difficult to wind the flat wire into a winding structure by means of a common winding machine; rather, a relatively complex manufacturing process (e.g., stamping or shearing) must be used to accomplish this. Consequently, producing a winding structure with such a flat wire leads to an increased manufacturing cost. Moreover, once the winding structure is completed, it is impossible to increase or decrease the wire cross section of the winding structure.

Accordingly, an urgent need exists in the art to provide a winding structure that can improve the aforesaid shortcomings.

SUMMARY OF THE INVENTION

The primary objective of the present invention is to provide a combined winding structure and a magnetic device comprising the same. The combined winding structure is applicable to large-current applications and has a low manufacturing cost.

To achieve the aforesaid objective, the combined winding structure disclosed in the present invention comprises: a first winding wire, having a first winding portion which is hollow columnar, a first anodic portion and a first cathodic portion, with the first anodic portion and the first cathodic portion each being integrally extended from the first winding portion; and a second winding wire, having a second winding portion which is hollow columnar, a second anodic portion and a second cathodic portion, with the second anodic portion and the second cathodic portion each being integrally extended from the second winding portion. The first winding portion is located inside and surrounded by the second winding portion.

To achieve the aforesaid objective, another combined winding structure disclosed in the present invention comprises: a plurality of winding wires, each having a winding portion which is hollow columnar, an anodic portion and a cathodic portion, with the anodic portion and the cathodic portion each being integrally extended from the winding portion. The winding portions each are defined with a surrounding dimension. The surrounding dimensions are mutually different, and the winding portion with the smaller surrounding dimension is located inside and surrounded by the winding portion with the larger surrounding dimension.

To achieve the aforesaid objective, the magnetic device disclosed in the present invention comprises: a core structure having a magnetic column; and the aforesaid combined winding structures. The magnetic column of the core structure is located inside and surrounded by the first winding portion.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
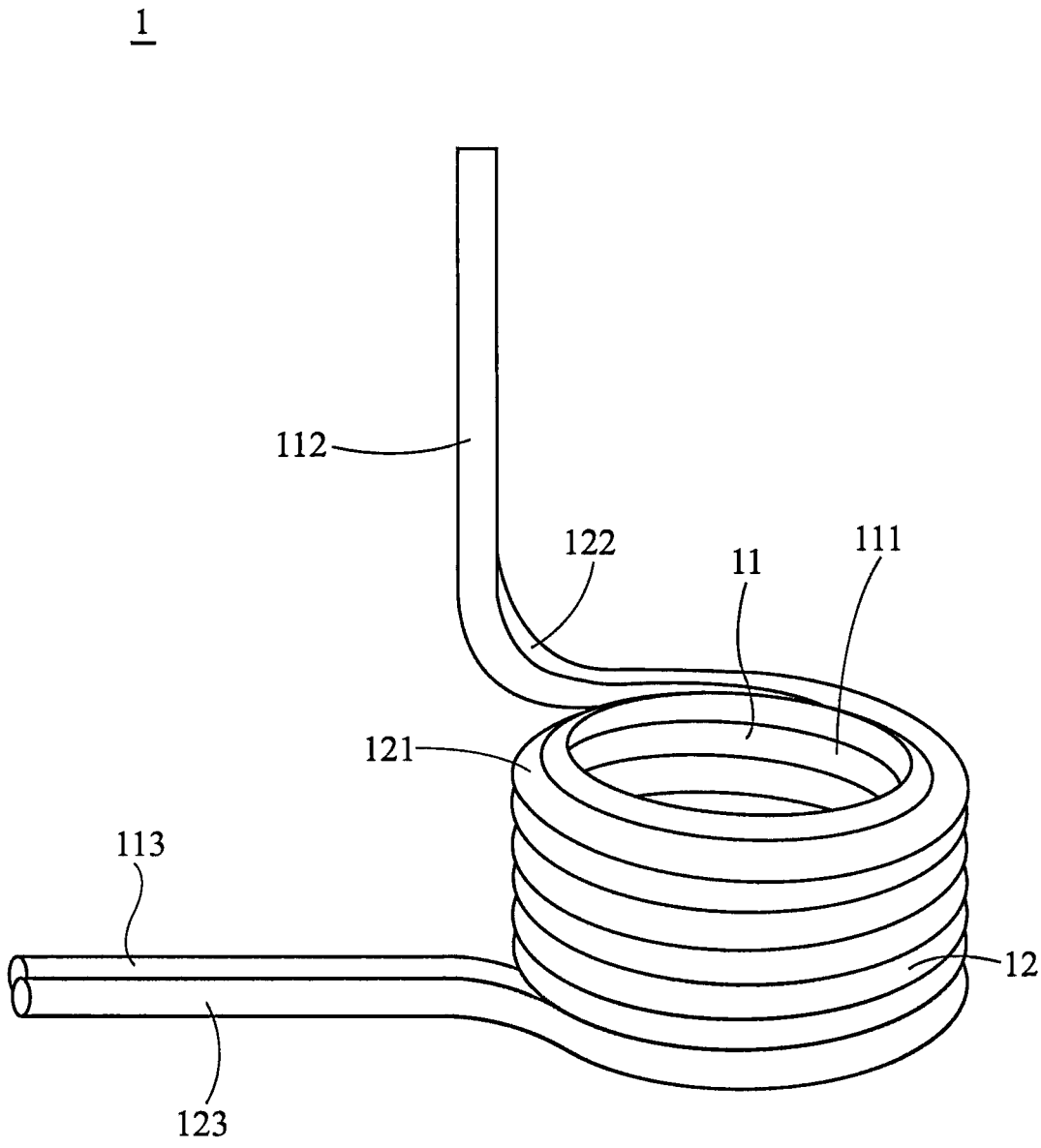
FIG. 1 is a perspective assembly view of a first preferred embodiment of a combined winding structure according to the present invention.
Figure 2:
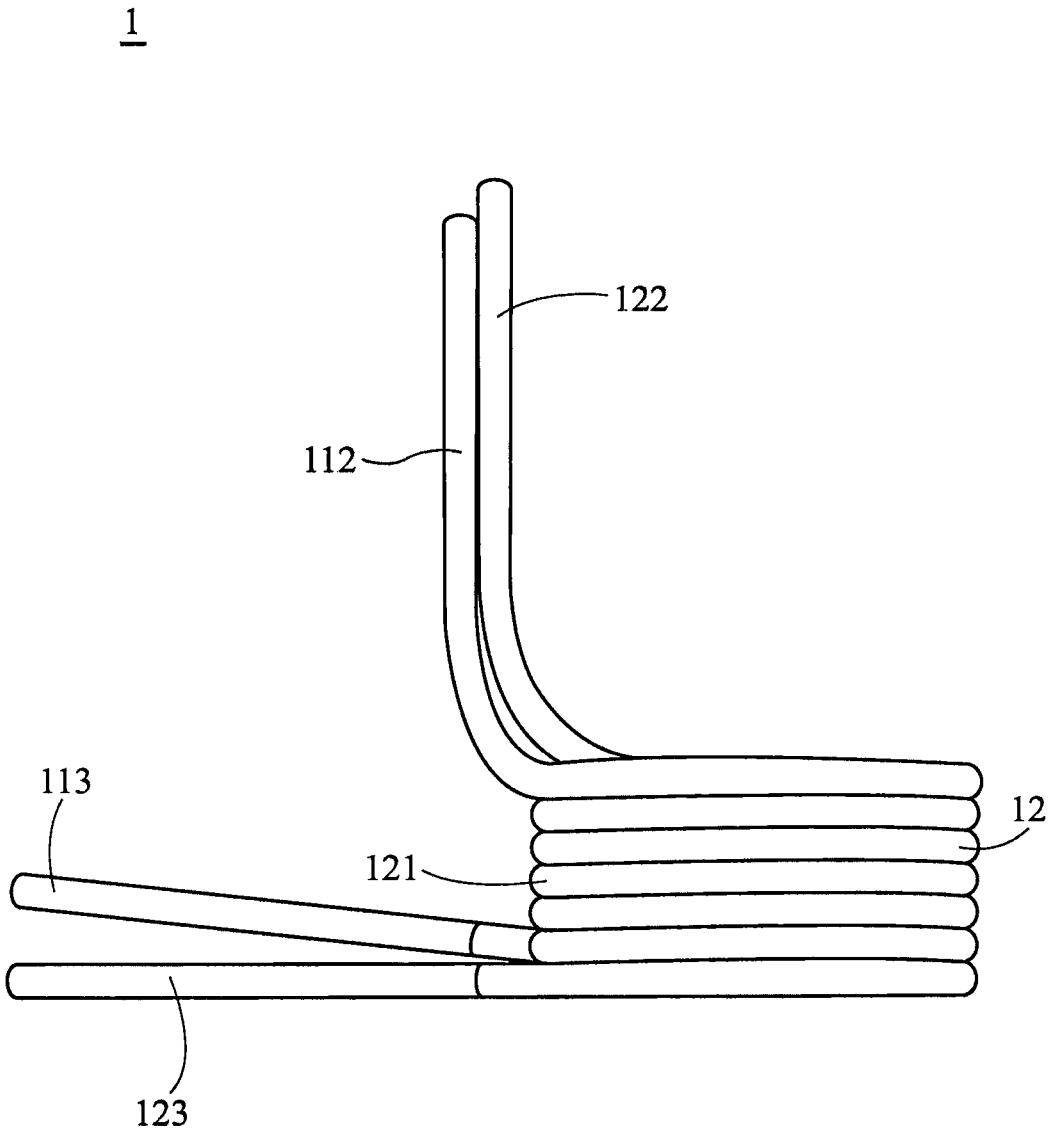
FIG. 2 is a plan assembly view (front view) of the first preferred embodiment of the combined winding structure according to the present invention.
Figure 3:
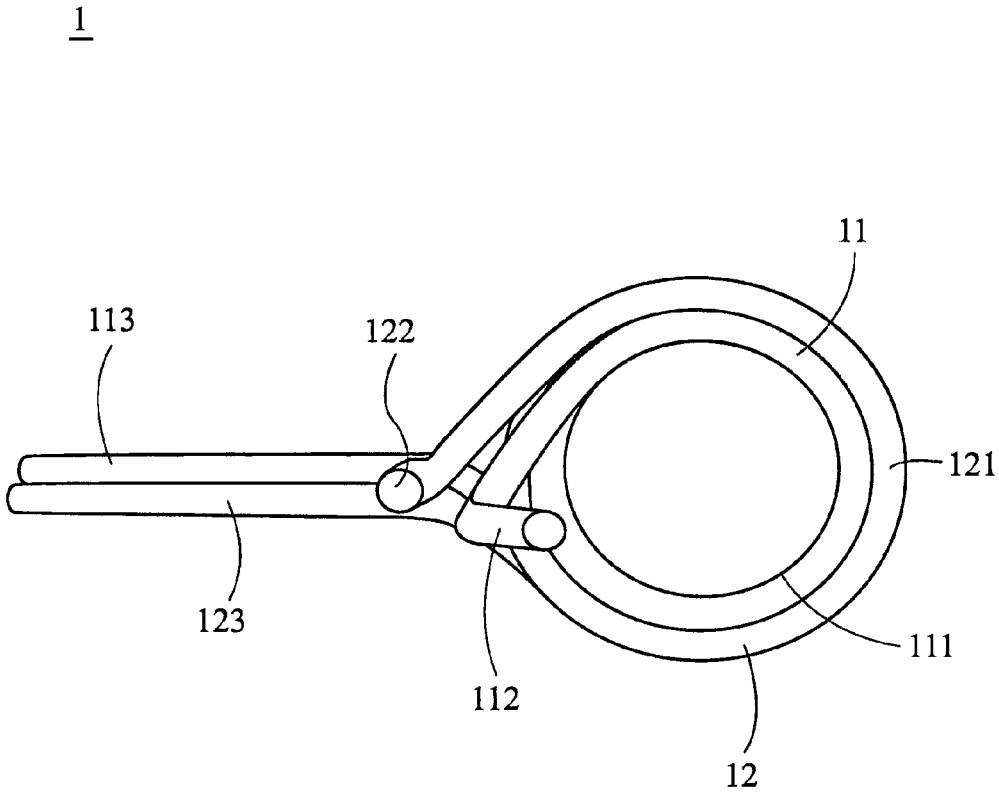
FIG. 3 is another plan assembly view (top view) of the first preferred embodiment of the combined winding structure according to the present invention.

In reference to FIGS. 1 to 3 illustrate a perspective assembly view and a plan assembly view of a first preferred embodiment of a combined winding structure 1 according to the present invention respectively. The combined winding structure 1 may comprise two winding wires 11 and 12. For ease of description, the two winding wires 11 and 12 are called a first winding wire 11 and a second winding wire 12 respectively. Hereinafter, the first winding wire 11 and the second winding wire 12 will be detailed in sequence.

Figure 4:
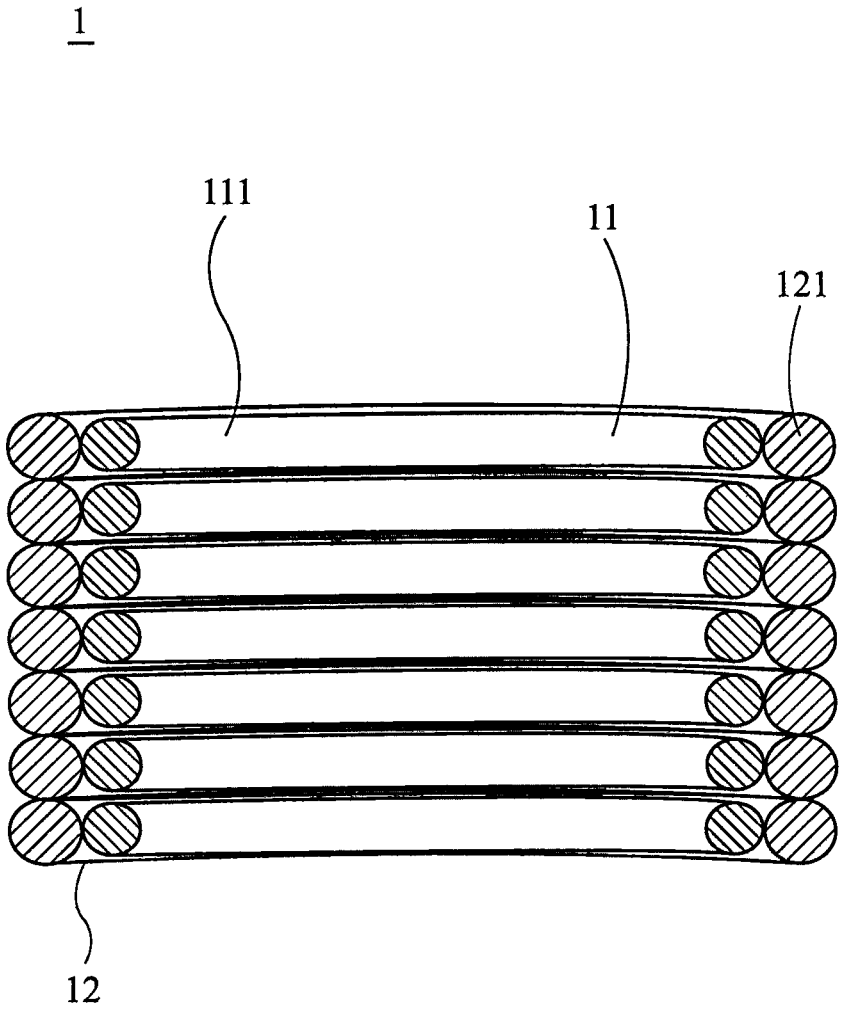
FIG. 4 is yet another plan assembly view (cross-sectional view) of the first preferred embodiment of the combined winding structure according to the present invention.
Figure 5:
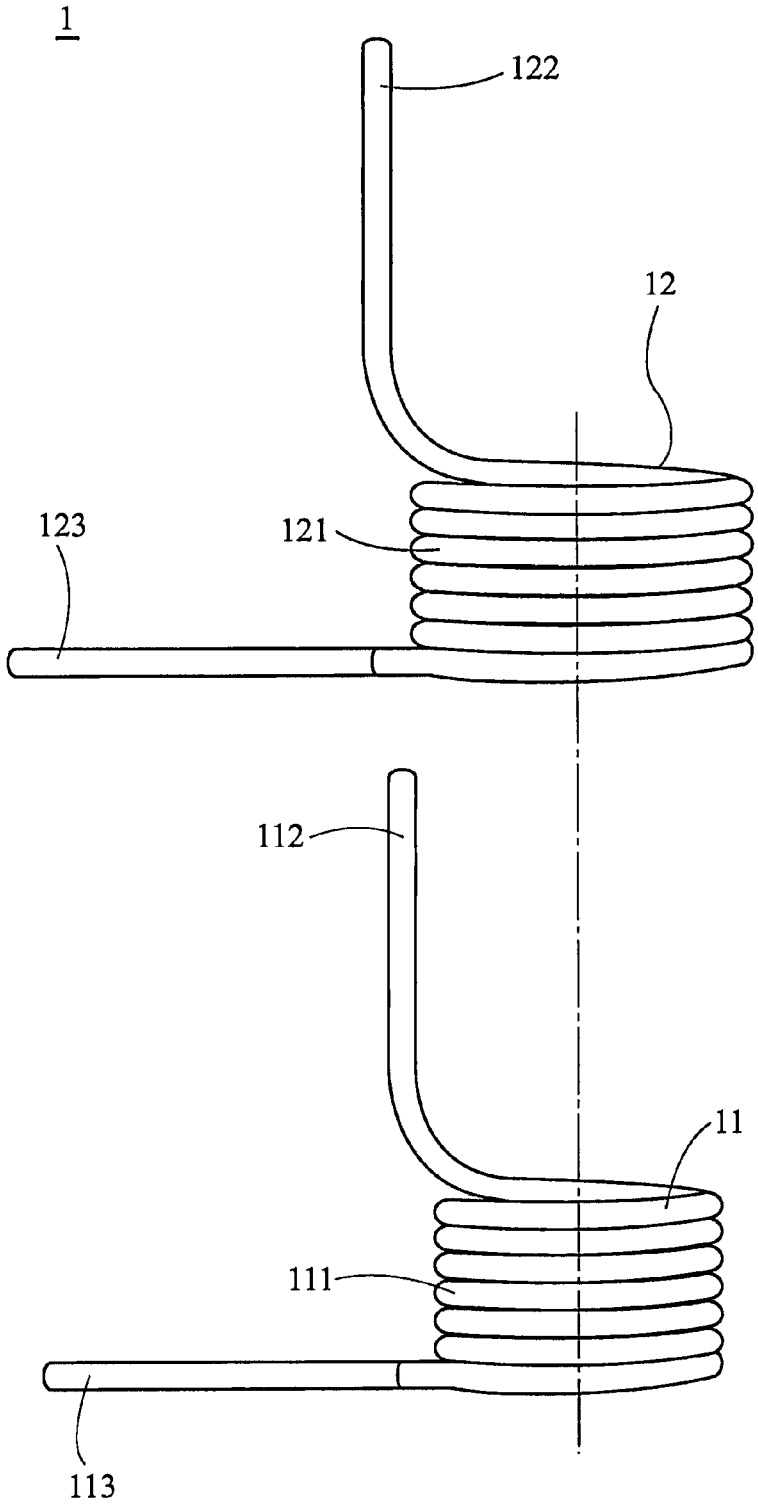
FIG. 5 is a plan exploded view (front view) of the first preferred embodiment of the combined winding structure according to the present invention.

In reference to both FIGS. 4 and 5, the first winding wire 11 may be an enameled wire (a copper wire covered by an insulated sheath) and have a round cross section. The first winding wire 11 is formed by being wound around a column (not shown) spirally; however, two ends of the first winding wire 11 are not wound around the column. Thus, when the column is separated from the first winding wire 11, the first winding wire 11 has a first winding portion 111 in a hollow column form (i.e. the first winding portion 111 is hollow columnar), a first anodic portion 112 and a first cathodic portion 113.

As a portion originally wound around the column, the first winding portion 111 is also in a column form in appearance; and the term "hollow" means that the first winding portion 111 is not solid and, instead, a space is formed therein to accommodate other objects (not shown). Additionally, the first winding portion 111 is defined with a surrounding dimension, which represents a size of the space it surrounds. For instance, if the first winding portion 111 is in the form of a cylinder, the surrounding dimension is defined as a diameter of the cylinder; and if the first winding portion 111 is in the form of a rectangular column, the surrounding dimension is defined as a side length of the rectangular column.

The first anodic portion 112 and the first cathodic portion 113 are two ends of the first winding wire 11 which are integrally extended from the first winding portion 111 respectively. The first anodic portion 112 and the first cathodic portion 113 are adapted to be electrically connected to an anode and a cathode of a power source respectively; and electric energy from the power source is inputted from the first anodic portion 112 into the first winding wire 11, then passes through the first winding portion 111, and is finally outputted from the first cathodic portion 113. It shall be appreciated that the insulated sheath of the first anodic portion 112 and the first cathodic portion 113 may be partially or completely removed to expose the copper wire for ease of electrical connection.

Similar to the first winding wire 11, the second winding wire 12 has a second winding portion 121 in a hollow column form (i.e. the second winding portion 121 is hollow columnar), a second anodic portion 122 and a second cathodic portion 123, with the second anodic portion 122 and the second cathodic portion 123 each being integrally extended from the second winding portion 121. The second winding portion 121 is also defined with a surrounding dimension which is larger than that of the first winding portion 111. In other words, the space surrounded by the second winding portion 121 is larger than that surrounded by the first winding portion 111.

When the first winding wire 11 is assembled with the second winding wire 12, the first winding portion 111 is located inside and also surrounded by the second winding portion 121. In other words, the second winding portion 121 fits over the first winding portion 111. The first anodic portion 112 and the second anodic portion 122 are electrically conducted to each other to form a short circuit, and the first cathodic portion 113 and the second cathodic portion 123 are electrically conducted to each other; in other words, the first winding wire 11 and the second winding wire 12 are connected in parallel.

Thus, an equivalent wire cross section of the combined winding structure 1 is equal to a sum of the cross section of the first winding wire 11 and the cross section of the second winding wire 12. The equivalent wire cross section is close to that of a prior art flat conductive wire, so the combined winding structure 1 is also applicable to large-current applications.

Additionally, it is worth noting that electric conduction (i.e., a short circuit) between the first anodic portion 112 and the second anodic portion 122 or between the first cathodic portion 113 and the second cathodic portion 123 described above may be accomplished in various ways. For instance, the first anodic portion 112 and the second anodic portion 122 are soldered with each other, and so are the first cathodic portion 113 and the second cathodic portion 123. On the other hand, the first anodic portion 112 and the second anodic portion 122 may be arranged abreast to come into contact with each other; and likewise, the first cathodic portion 113 and the second cathodic portion 123 may be arranged abreast to come into contact with each other. The first anodic portion 112 and the second anodic portion 122 may also be electrically connected to each other by a connector (not shown), similar for the connection between first cathodic portion 113 and the second cathodic portion 123. Alternatively, the first anodic portion 112 and the second anodic portion 122 may be connected to two contacts, which are short circuited from, of a circuit board respectively to be electrically conducted to each other as well.

Figure 6:
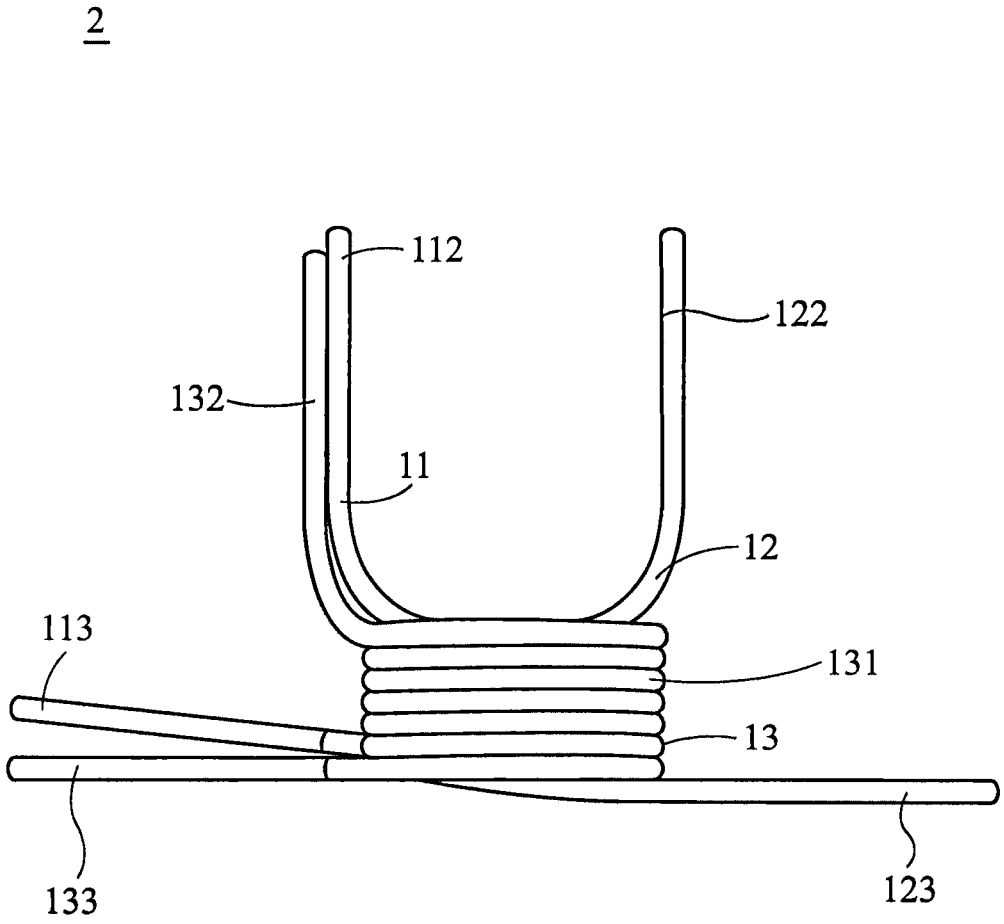
FIG. 6 is a plan assembly view (front view) of a second preferred embodiment of the combined winding structure according to the present invention.
Figure 7:
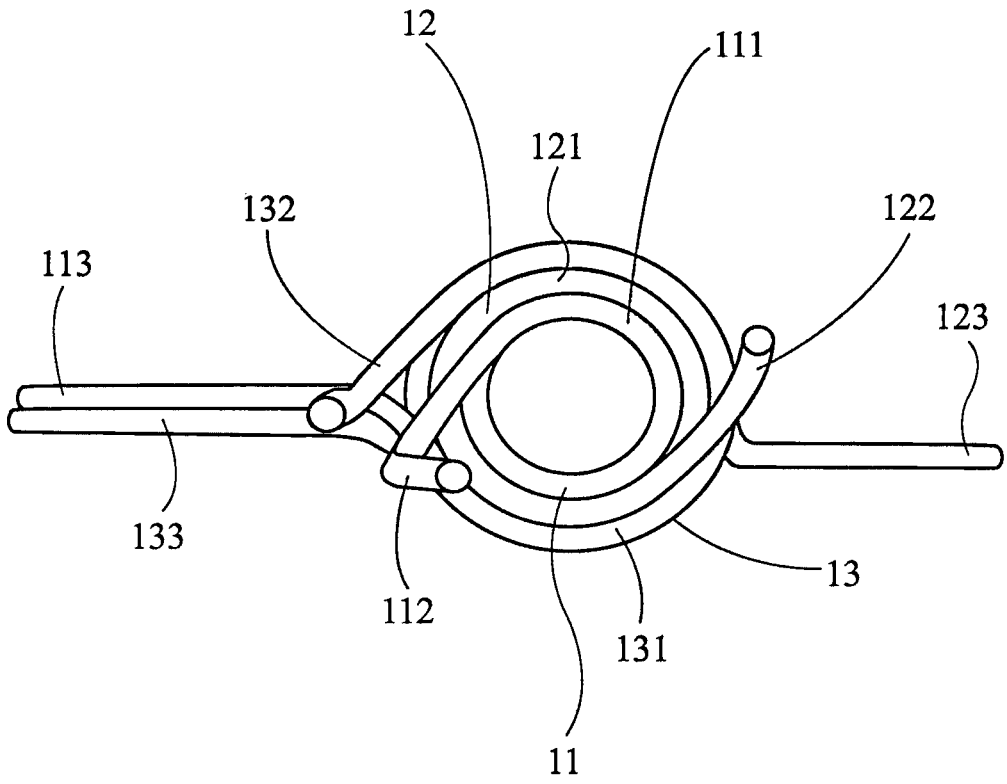
FIG. 7 is another plan assembly view (top view) of the second preferred embodiment of the combined winding structure according to the present invention.

In reference to FIGS. 6 and 7 show plan assembly views of a second preferred embodiment of the combined winding structure according to the present invention. Similar to the combined winding structure 1 of the first preferred embodiment, the combined winding structure 2 of the second preferred embodiment also comprises the first winding wire 11 and the second winding wire 12, but further comprises a third winding wire 13.

Specifically, similar to the first winding wire 11 and the second winding wire 12, the third winding wire 13 also comprises a third winding portion 131 in a hollow column form (i.e. the third winding portion 131 is hollow columnar), a third anodic portion 132 and a third cathodic portion 133, with the third anodic portion 132 and the third cathodic portion 133 each being integrally extended from the third winding portion 131. The third winding portion 131 is defined with a surrounding dimension, which is larger than that of the second winding portion 121. Therefore, the space surrounded by the third winding portion 131 is larger than that surrounded by the second winding portion 121.

When the third winding wire 13 is assembled with the second winding wire 12, the second winding portion 121 is located inside and is also surrounded by the third winding portion 131. In other words, the third winding portion 131 fits over the second winding portion 121. The first anodic portion 112, the second anodic portion 122 and the third anodic portion 132 are electrically conducted to each other, and the first cathodic portion 113, the second cathodic portion 123 and the third cathodic portion 133 are also electrically conducted to each other. Thus, the first winding wire 11, the second winding wire 12 and the third winding wire 13 are connected in parallel.

Thus, an equivalent wire cross section of the combined winding structure 2 is larger than that of the combined winding structure 1 so that the combined winding structure 2 is able to withstand a larger current.

It is worth noting that the first anodic portion 112 may be only electrically conducted to the third anodic portion 132, and is electrically isolated (not in short circuit or electric conduction) with the second anodic portion 122; likewise, the first cathodic portion 113 may be only electrically conducted to the third cathodic portion 133, and is electrically isolated with the second cathodic portion 123. Thereby, the combined winding structure 2 may be applied in a transformer (not shown), in which case the first winding wire 11 and the third winding wire 13 thereof may be used as primary windings of the transformer while the second winding wire 12 may be used as a secondary winding of the transformer.

Additionally, in consideration of safety regulations of transformers that sufficient insulation shall be provided between the primary winding(s) and the secondary winding (s), the second winding wire 12 may be a triple insulated wire (a copper wire covered by triple insulated sheath).

Figure 8:
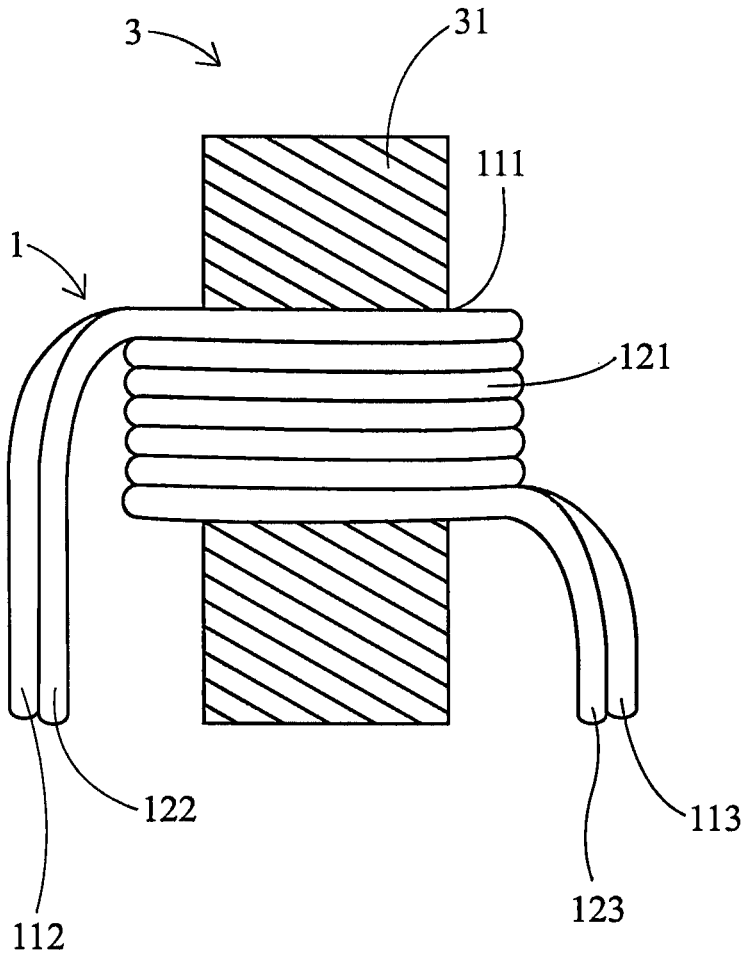
FIG. 8 is a schematic plan view of a magnetic device using a combined winding structure according to the present invention.

Hereinafter, how the combined winding structure of the present invention is applied in a magnetic device will be described. In reference to FIG. 8 illustrates a schematic plan view of a magnetic device using the combined winding structure according to the present invention. The magnetic device is an inductor which, in addition to a combined winding structure of the present invention (e.g., the combined winding structure 1 of the first preferred embodiment), further comprises a core structure 3.

Specifically, the core structure 3 is made of a magnetic permeability material (e.g., a metal) and has at least one magnetic column 31. The magnetic column 31 may be located inside and is also surrounded by the first winding portion 111. Thus, a current can be inputted into the combined winding structure 1 to generate magnetic lines of force. The magnetic lines of force generated by the combined winding structure 1 are mostly distributed outside the core structure 3, so the magnetic device may be called an open inductor.

Figure 9:
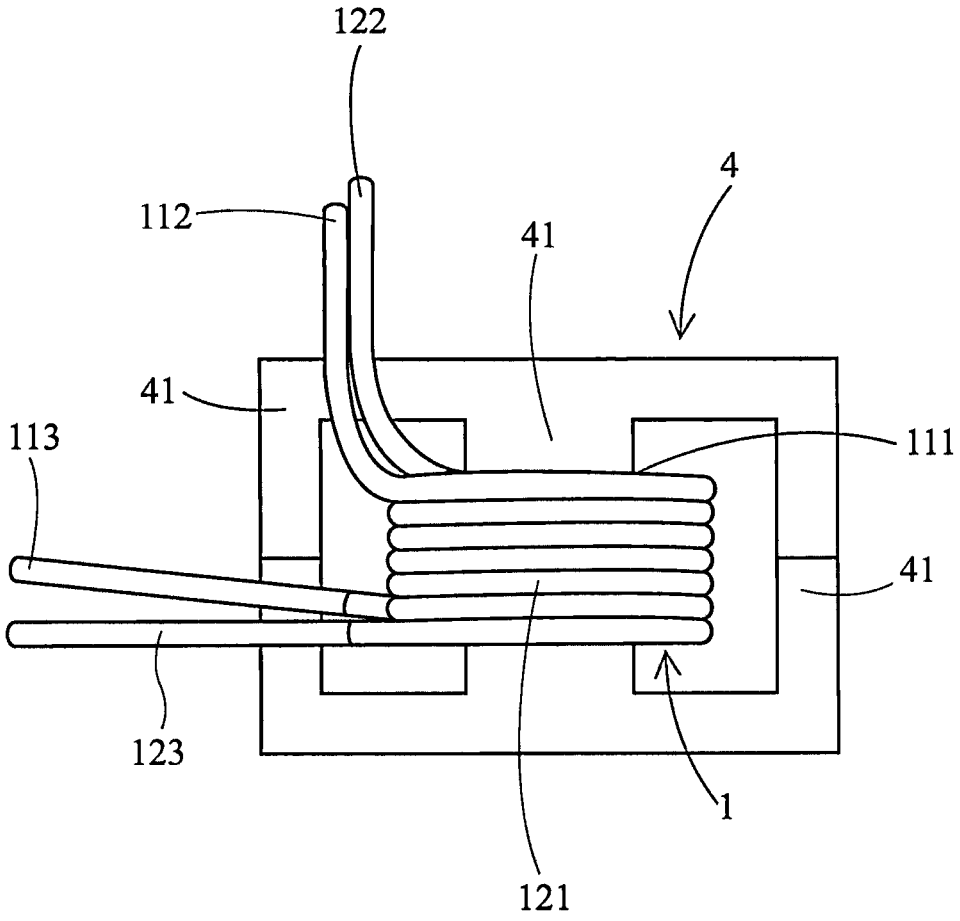
FIG. 9 is a schematic plan view of another magnetic device using a combined winding structure according to the present invention.

In reference to FIG. 9 illustrates a schematic plan view of another magnetic device using the combined winding structure according to the present invention. The magnetic device is also an inductor, which comprises a combined winding structure (e.g., the combined winding structure 1 of the first preferred embodiment) and a core structure 4.

Specifically, the core structure 4 has three magnetic columns 41, a middle one of which is located inside and is also surrounded by the first winding portion 111. Thus, the magnetic lines of force generated when a current is inputted into the combined winding structure 1 are mostly distributed inside the core structure 4 so that the magnetic device may be called a closed inductor.

Figure 10:
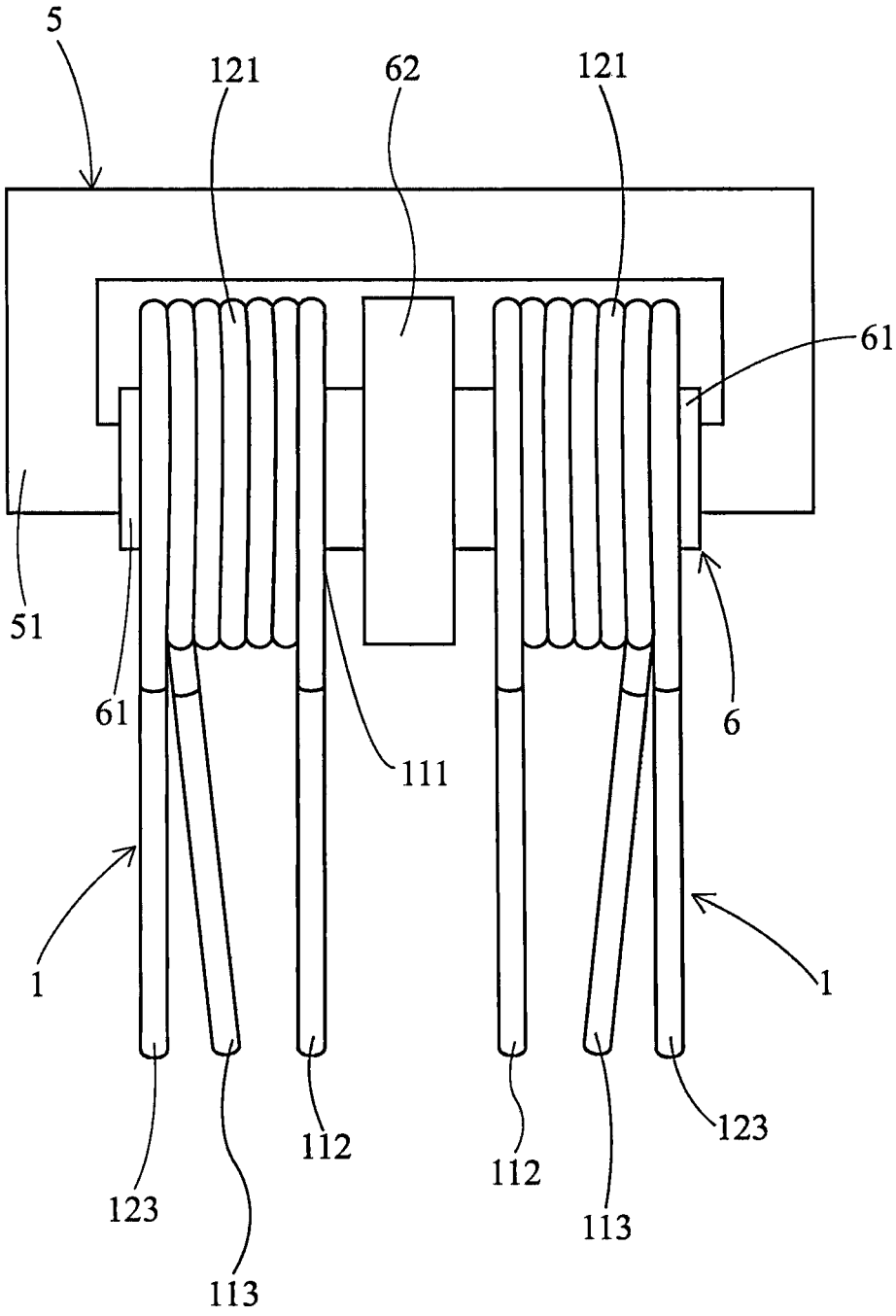
FIG. 10 is a schematic plan view of yet another magnetic device using a combined winding structure according to the present invention.

In reference to FIG. 10 illustrates a schematic plan view of yet another magnetic device using a combined winding structure according to the present invention. The magnetic device is a filter, which comprises two combined winding structures (e.g., each being the combined winding structure 1 of the first preferred embodiment), a core structure 5 and a bobbin 6.

Specifically, the bobbin 6 has two columns 61 and a partition plate 62 located between the two columns 61. The two columns 61 are located inside and are also surrounded by the first winding portions 111 of the two combined winding structures 1 respectively. The two combined winding structures are isolated by the partition plate 62 to increase the creepage distance therebetween. A magnetic column 51 of the core structure 5 passes through the two columns 61 and the partition plate 62 of the bobbin 6 so that the magnetic column 51 may also be regarded to be located inside and surrounded by the winding portions 111.

According to the above descriptions, the combined winding structure of the present invention has at least the following features:

1. The combined winding structure may comprise a plurality of windings, including but not limited to two or three. The larger the number of windings, the larger the equivalent wire cross-section and, consequently, the more applicable to the combined winding structure.

2. The windings can be formed by a common winding machine. The winding portion with the larger surrounding dimension fits over the winding portion with the smaller surrounding dimension to form the combined winding structure. In other words, the combined winding structure can be manufactured more easily so that it has a low manufacturing cost.

3. The number of the windings of the combined winding structure can be readily extended by just fitting a winding portion with an even larger surrounding dimension over the preexistent winding portions.

4. The combined winding structure can be applied in various magnetic devices, such as an inductor, a filter, a transformer or the like.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A combined winding structure for a magnetic device, the combined winding structure comprising:

a first winding wire, having a first winding portion which is hollow columnar, a first anodic portion and a first cathodic portion, and the first anodic portion and the first cathodic portion each being integrally extended from the first winding portion; and a second winding wire, having a second winding portion which is hollow columnar, a second anodic portion and a second cathodic portion, and the second anodic portion and the second cathodic portion each being integrally extended from the second winding portion;

wherein the first winding portion is located inside the second winding portion and surrounded by the second winding portion;

wherein the first anodic portion and the second anodic portion are arranged abreast so as to make contact with each other and electrically conducted to each other, and the first cathodic portion and the second cathodic portion are arranged abreast so as to make contact with each other and electrically conducted to each other.

2. The combined winding structure of claim 1, wherein the first anodic portion and the second anodic portion are soldered with each other, and the first cathodic portion and the second cathodic portion are soldered with each other.

3. The combined winding structure of claim 1, further comprising a third winding wire, wherein the third winding wire has a third winding portion which is hollow columnar, a third anodic portion and a third cathodic portion, and the third anodic portion and the third cathodic portion each are integrally extended from the third winding portion;

wherein the second winding portion is located inside the third winding portion and surrounded by the third winding portion.

4. The combined winding structure of claim 3, wherein the first anodic portion, the second anodic portion and the third anodic portion are electrically conducted to one another, and the first cathodic portion, the second cathodic portion and the third cathodic portion are electrically conducted to one another.

5. A combined winding structure for a magnetic device, the combined winding structure comprising:

a plurality of winding wires, each having a winding portion which is hollow columnar, an anodic portion and a cathodic portion, and the anodic portion and the cathodic portion each being integrally extended from the winding portion;

wherein the winding portions each are defined with a surrounding dimension, the surrounding dimensions are mutually different, the winding portion with the smaller surrounding dimension is located inside and surrounded by the winding portion with the larger surrounding dimension;

wherein the anodic portions are arranged abreast so as to make contact mutually and electrically conducted mutually, and the cathodic portions are arranged abreast so as to make contact mutually and electrically conducted mutually.

6. A magnetic device, comprising:

a core structure, having a magnetic column; and the combined winding structure of claim 1, wherein the magnetic column of the core structure is located inside the first winding portion and surrounded by the first winding portion.

7. The magnetic device of claim 6, wherein the magnetic device is an inductor, or a filter.

* * * * *